United States Patent [19]

Appleton

[11] Patent Number: 4,726,784

[45] Date of Patent: Feb. 23, 1988

[54] CONNECTOR FOR TERMINAL FREE CABLE

[76] Inventor: Arthur I. Appleton, 22 Indian Creek Island, Miami Beach, Fla. 33154

[21] Appl. No.: 885,031

[22] Filed: Jul. 14, 1986

[51] Int. Cl.[4] ..... H01R 4/24

[52] U.S. Cl. ..... 439/409

[58] Field of Search ..... 339/97 R, 97 P, 98, 339/99 R, 41; 439/389, 391, 409, 416

[56] References Cited

U.S. PATENT DOCUMENTS

| | | | |
|---|---|---|---|
| 2,680,145 | 6/1954 | Lanfear | 439/409 |
| 3,605,073 | 9/1971 | Vetter | 439/409 |
| 4,040,701 | 8/1977 | Gressit | 339/99 R |
| 4,157,208 | 6/1979 | Roberts et al. | 339/98 |
| 4,318,580 | 3/1982 | Fleischer et al. | 339/98 |
| 4,340,270 | 7/1982 | Wilmes et al. | 439/409 |
| 4,341,430 | 7/1982 | Crawford | 439/409 |
| 4,426,125 | 1/1984 | Crawford | 439/409 |

*Primary Examiner*—John McQuade

*Attorney, Agent, or Firm*—Jones, Day, Reavis & Pogue

[57] ABSTRACT

A connector for antenna cable, stereo system cable, household lamp and appliance cable or the like is arranged to receive those cables without any connection or termination apparatus on the cable's end such as a spade terminal or plug. The connector includes a rotating element having an orifice therein that is appropriately shaped to matingly receive a preferably flat cable, and it also includes a fixed terminal with at least one piercing point that pierces the insulation of the cable when the rotating element is rotated through a specific angle to a specific position, whereby an electrical connection is achieved and releasably held under pressure.

6 Claims, 9 Drawing Figures

CONNECTOR FOR TERMINAL FREE CABLE

BACKGROUND OF THE INVENTION

The prior art shows many devices intended to quickly connect a pair of flat cables or provide a terminal connection by piercing the cable insulation. Several isolated examples of a piercing type of device are shown and described in U.S. Pat. Nos. 3,835,445 to Hardesty, in 3,691,510 to Lehmann and in 3,816,819 to Judd. In each of these devices, a plurality of parallel connectors in a flat cable are inserted axially into the end of the device, and the cable is thereafter linearly cammed into a plurality of fixed piercing point terminals within the connector device. An isolated example of a connector incorporating a rotating rather than linear camming action is shown in the U.S. Pat. No. 3,980,380 to Cieniawa et al. In the latter patent, however, a multiconductor round cable is prepared to cooperate with the connector by first being stripped of its outer insulation covering to expose a plurality of individually round insulated conductors. Each of this plurality of separate conductors is then fed into a separate hole in the connector.

One of the principal problems with the first mentioned three patents as well as most other flat cable connectors is that the cable, once pressed into the piercing points, does not automatically become free when the piercing process is reversed. In other words, the cam or lever or other element used to press the flat cable into the terminals' piercing points does not pull the cable free of the piercing points when it is opened to permit release of the cable. Thus, opening the connector does not entirely free the cable, and a separate manual manipulation is necessary to do that in order to avoid injurying either the cable, the terminal piercing points or some other part of the connector. Stated another way, the same element that drives the cable into the piercing points when the connection is made does not also pull the cable away from the piercing points when it is opened. Referring now to the last mentioned or Cieniawa et al patent, one of its principal problems is that it requires special preparation of the end of the cable before it is usable.

Another concept not as yet located in the prior art is that of a simple, flat cable connector which can be connected at each end into a different device without any advance preparation of the cable at either end.

SUMMARY OF THE INVENTION

The primary objective of this invention is to provide a preferably flat cable connector into which one end of a flat cable can be inserted without preliminary preparation or the attachment thereto of a terminal, plug or some other device. The invention has a number of applications including those of providing a simple and quick connection of an antenna cable into a television receiver or similar equipment; providing connections between stereo system components; and also providing a simple and quick connection for ordinary lamp and appliance cable either into the lamp or appliance itself, into a wall receptacle or into both. In the last two applications, the necessity for the plug normally carried on lamp and appliance cables is entirely eliminated. In the first two examples dealing with television antennas or stereo component cables, the need to strip common antenna wire and mount spade terminals or the like thereon is also eliminated. Therefore, persons who are not equipped or adept at stripping the end of a cable and thereafter mounting either a plug or one or more antenna cable lugs or terminals on the end thereof can make use of this invention simply by cutting the cable to the appropriate length (to avoid unsightly lengths of loose cable from lying around), and they can thereafter simply insert the severed cable end into this cable connector and rotate a portion of the connector to effect a connection with ease. The same advantage is afforded in any application using a similar type of cable. And when each of two electrical devices are equipped with this connector, the cord or cable therebetween can be replaced in a matter of seconds without tools or the need to install a plug or in any way requiring the disassembling or opening of the item or equipment on which the connector is mounted. Rewiring can thus be done safely even where the installer forgets to turn off the power.

The connector of this invention incorporates rotatable means in the form of a cylindrical element defining a transversely elongated cable-receiving orifice therein of generally the same cross-sectional dimensions as the cord or cable with which it is used. When that rotatable element is in its first or "open" position, the transversely elongated orifice is open and unobstructed to entry of the cable. However, when the element is rotated 90° to its second or "closed" position, the transversely outermost portions of the orifice swing into space already occupied by the connector's terminal piercing point or points. Therefore, after the cord or cable or wire is inserted axially into the rotatable element and the rotatable element is thereafter turned through a limited arc, the conductors within the cable are thereby shifted laterally in opposite directions into a different fixed terminal piercing point or points which pierces the cable's insulation and thereby forms the electrical connection. When it is desired to remove the cable, the rotatable element is rotated in reverse to its first or open location which physically moves the cable laterally away from the piercing points and permits it to be removed without resistance because the piercing points no longer are located within the rotating elements cable-receiving orifice so as to obstruct it. The combination of no advance cable preparation plus positive separation of piercing point or points from the cable is a decided advantage over known prior art uncovered thus far, and although the connector is not intended to be used as a switch, the operation of this connector does resemble that of a switch in the sense that the first and second positions of the rotatable element positively establish either an open or closed electrical condition. Connections can thus be made safely even though the power had not been turned off.

DESCRIPTION OF PREFERRED EMBODIMENTS

The following disclosure is offered for public dissemination in return for the grant of a patent. Although it is detailed to insure adequacy and aid understanding, that is not intended to prejudice that purpose of a patent which is to cover each new inventive concept therein no matter how others may later disguise it by variations in form or additions or further improvements.

Figure 1:
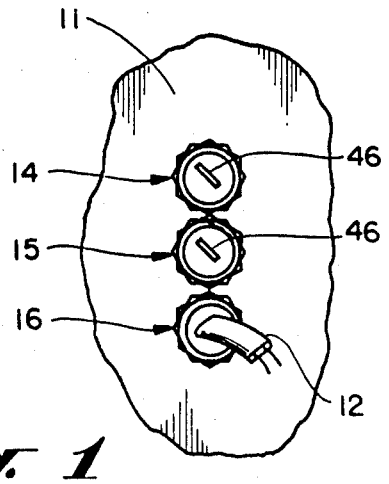
FIG. 1 is a front view of a panel fragment from a television receiver or other device which has mounted thereon one prefered embodiment of a cable connector assembly embodying the principles of the present invention, this view showing those portions of the assembly which protrude forwardly through the panel and are normally visible to its user.
Figure 2:
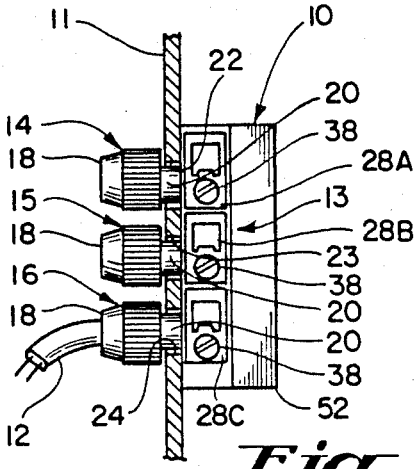
FIG. 2 is a side elevation of the connector shown in FIG. 1.
Figure 3:
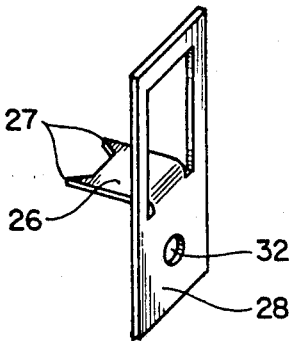
FIG. 3 is a perspective view of one of the fixed terminals shown in FIG. 2.

Referring now to the figures in detail, there is shown in FIG. 2 a complete connector means in the form of an assembly generally 10 mounted on a portion of a panel 11 which might comprise, for example, a part of the rear cover of a television or stereo receiver. Connector assembly 10 is designed to receive one or more cables 12, and it includes a main body 13 positioned to the rear side of panel 11. Main body 13 is captivated to panel 11 in this embodiment by rotating means in the form of three rotating elements 14, 15, and 16. Rotating elements 14–16 each include a forwardmost and generally cylindrical knob portion 18 situated in front of panel 11 so as to be both visible and accessible, and they also each include a rearwardly extending shaft portion 20 that extends through appropriately placed holes 22–24 in the panel 11 and therebehind into cavities 25 in the the main body 13. These shafts 20 rotate about their own longitudinal axis and are captivated in the main body 13 by the protruding piercing point portions 26 of a plurality of terminal means shown in FIG. 2 as terminals 28A, 28B, and 28C. Although not visible in FIG. 2, there are also three corresponding but inverted terminal means 28D–28F carried on the opposite side of the main body and rearwardly of terminals 28A–28C, each and all of these terminals being referred to generally as terminals 28. One of these terminals 28 is shown enlarged in perspective view in FIG. 3. It consists essentially of a rectangular piece of thin conductive metal having a central portion 26 struck outwardly at a right angle from its center, portion 26 also defining in part a pair of piercing points 29. Terminal 28 also has a hole 32 therethrough which is used in conjunction with one of three tapped holes 34–36 in the main body 13 (see FIG. 4). Each of the terminals 28 is fixedly mounted to the main body 13 by means of a screw 38 which extends through the terminal's hole 32 and into a tapped hole 34–36. Each of the screws 38 is intended to also function to receive under its head the stripped end of a conductor (not shown) to which one of the conductors within cable 12 is ultimately electrically connected.

Figure 4:
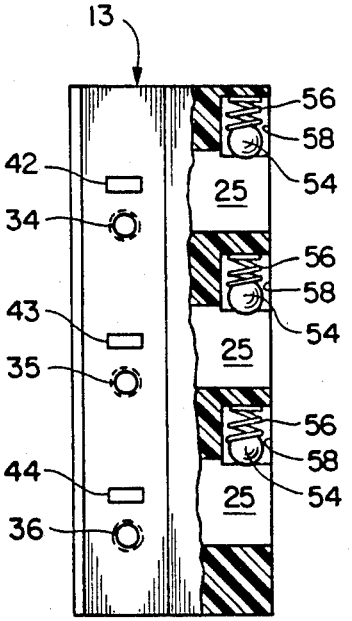
FIG. 4 is a side elevation of the main body portion of the connector shown in FIGS. 1-3, portions here being shown in cross section and also including one of the ball detents used therein.

Each of the terminals 28 have their portions 26 extending into the main body 13 through a rectangular opening therein such as shown, for example, at 42–44 in FIGS. 4. As will be more fully understood shortly, these portions 26 perform a dual function in the connector assembly: that of electrically connecting with the conductor within the cable 12 and also that of engaging the rearmost shaft portions 20 of the rotating elements 14–16 so that they cannot be removed axially from the connector assembly. This latter function thus also serves to captivate the connector assembly 10 to panel 11.

Figure 5:
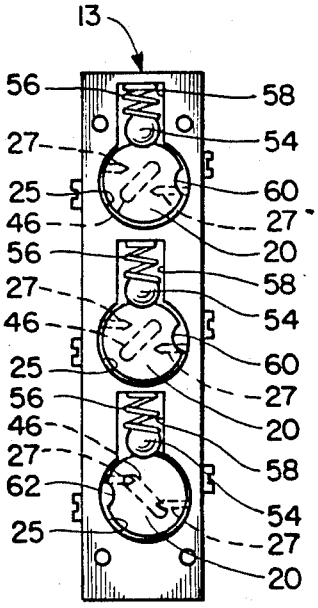
FIG. 5 is a rear elevation of the connector assembly shown in FIG. 2, but with the rear cover plate removed.
Figure 6:
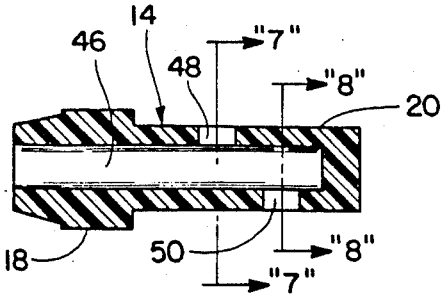
FIG. 6 is a side view of one of the rotating elements in cross section.
Figure 7:
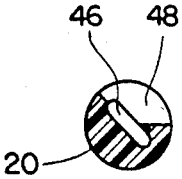
FIG. 7 is a cross sectional view of an entire rotating element taken generally along the lines 7—7 of FIG. 6.
Figure 8:
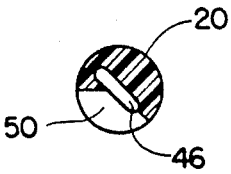
FIG. 8 is a cross sectional view of an entire rotating element taken substantially along the lines 8—8 of FIG. 6.

Referring now to FIGS. 6–8, it will be seen that each of the rotating elements 14–16 (only rotating element 14 being here shown) includes a blind cable-receiving orifice 46 extending axially therein from its frontmost knob portion 18. This cable-receiving orifice is not circular in cross section, but is rather laterally elongated so as to have a shape conforming rather closely with the cross sectional shape of the flat cable to be inserted therein. Shaft portions 20 of the rotating element include two longitudinally spaced cut-out segments 48 and 50 which extend from the lateral outer surface of each rotating element into the elongate orifice 46 therein. As will be understood, after the connector is assembled, piercing points 29 of each terminal 28 will extend both through the appropriate rectangular opening 42–44 in the main body and also into the appropriate cut-out segment 48 or 50 in the rotating element. The depth to which the piercing points 29 extend into the main body 12 is designed so that they are always contained either within the cut-out segment 48 on one side of the rotating element or within the other cut-out segment 50 on the other side of the rotating element, depending upon which side of the connector assembly the terminal is mounted. When a rotating element is in its first angular orientation which prepares it to receive a cable 12, however, the piercing points 29 do not protrude into its cable-receiving orifice 46. Referring specifically to FIG. 5, which comprises a rear elevational view of the main body 13 (but with the rear cover plate 45 removed), this view includes dashed invisible lines showing the two orientations of orifice 46 to facilitate a discussion of how the rotating elements operate so as to cause the cable 12 to engage and disengage the piercing points 29 of the terminals. In each of the cavities 25 normally occcupied by the shaft portion 20 of a rotating element, the piercing points 29 of one terminal 28 enter the cavity 25 above center from the left, whereas the piercing points 29 from a terminal 28 on the other side of the main body enter the cavity 25 below center from the right. Referring now specifically to rotating element 15 in the middle cavity 25 of FIG. 5, the orientation of its cable-receiving orifice 46 (shown in dashed lines) shows that the orifice 46 and piercing points 29 do not overlap or interfere with one another when the rotating element is in its first or open position. However, when the rotating element is rotated 90° from its first or open position to its second or closed position, as shown by rotating element 16 in the lower cavity 25 of the main body in FIG. 5, it can be seen that the outermost portions of the transversely elongated orifice 46 swing into the space already occupied by piercing points 29. It will therefore be understood that orifice 46 in the rotating element is open and free to accept the cable when it is in its first or open position, however, rotation of elements 14–16 to their second or closed position would cause a cable therein to engage and be pierced by the piercing points 29.

The installation of a connector assembly 10 onto a panel 11 is achieved simply by positioning main body 13 behind the holes 22–24 in the panel, pushing shaft portions 22 of rotating elements 14–16 through holes 22–24 and into the main body cavities, inserting portions 26 of terminals 28 through rectangular openings 42–44 in the main body and then securing these terminals by means of terminal screws 38. Portions 26 of the terminals extend through cut-out central segments 48 and 50 in the rotating elements 14–16 to effectively captivate the rotating elements inside the main body 13, yet they are free to rotate through a limited arc. A cover plate 52 can then be attached to the rear of the main body to ensure that detent means in the form of a ball 54 and spring 56 situated in hollows 58 provided therefor are capitivated within the connector assembly. As is visible in FIG. 5 (as well as in FIG. 9 to be described next), these detent means cooperate with relieved portions 60 and 62 at the exteme rear end of each of the rotating elements so as to cause these rotating elements to be releasably held in place in either their first or second positions once rotated there.

Figure 9:
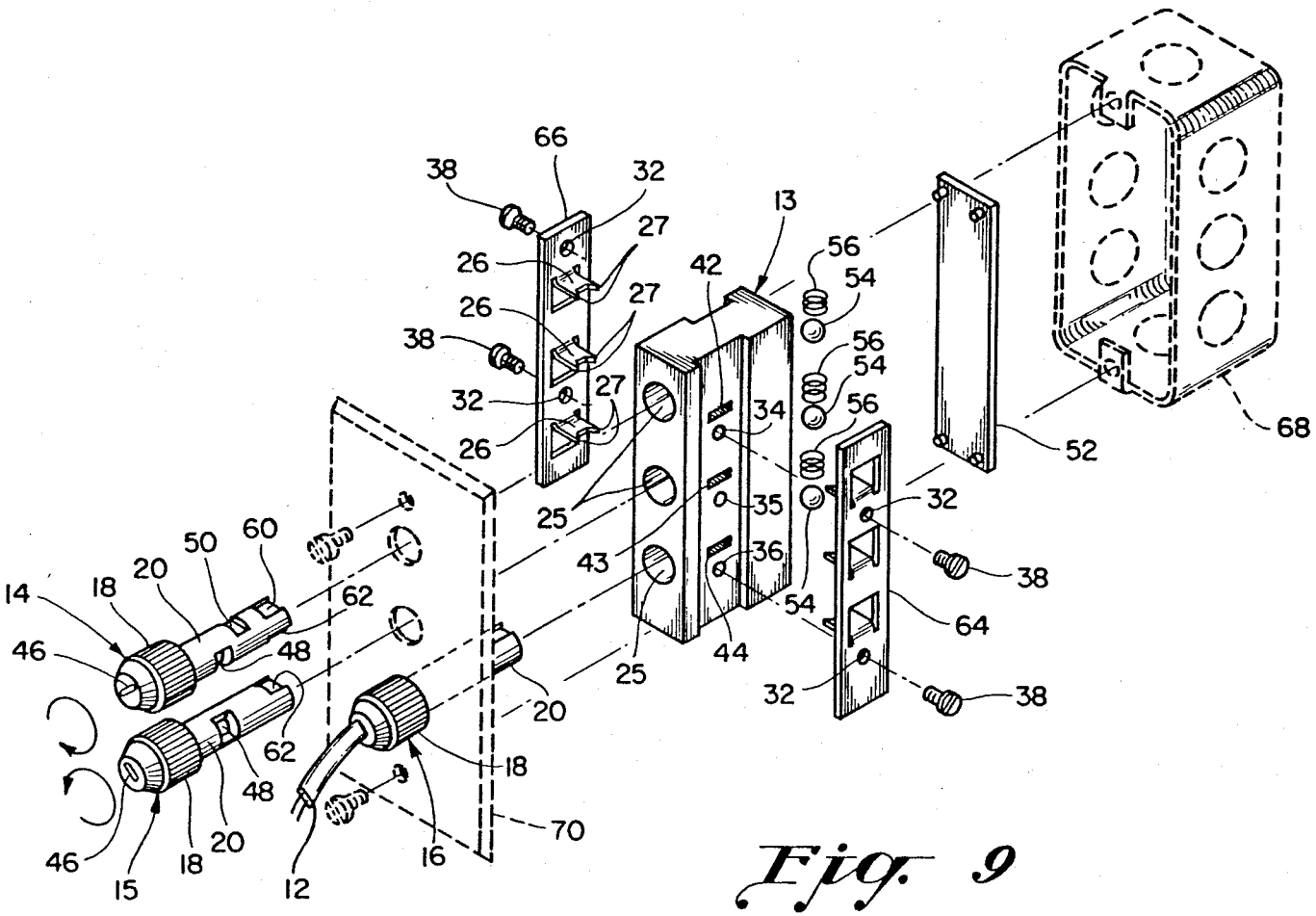
FIG. 9 is an exploded perspective view of a slightly modified cable connector, the principal difference being that the terminals on each side of the main body are integrally formed together so that the device is usable in place of an ordinary wall receptacle, this figure also showing an outlet box and faceplate in dashed lines.

Referring now to FIG. 9, there is shown a connector assembly in exploded, perspective view which is identical to the earlier described embodiment except for the terminals 28. Each bank of terminals 28A–28C and 28D–28F in this embodiment are integrally formed together. Therefore, all of the various elements of FIG. 9 carry the same reference numbers as the elements in the earlier described embodiment except for the terminals which here are integrally formed and are thus deisgnated 64 and 66. The terminals 64 and 66 of FIG. 9 adapt the connector assembly for such use as that of an ordinary household receptacle, and thus FIG. 9 also shows in dashed lines a standard outlet box 68 and faceplate 70. When used in this application, each of the two power lines entering outlet box 68 from the wall are attached to a different integral terminal 64,66 which thereby readies all three rotating elements 14–16 to supply power to any household cable connected therein. Used in this application, a lamp or appliance cord does not require a plug on its end. Rather, the cord can simply be inserted into the cable-receiving orifice 46 in a rotating element when it is in its first position, and the rotating element is then simply rotated to its second position to effect a connection.

The showing of three rotating elements in a connector assembly was an arbitrarily selection. A given connector assembly may be designed to accomodate any number of rotating elements. For example, connector assembly consisting of a small main body and a single rotating element could be installed in the base of a lamp or appliance, and another connector assembly could be mounted on an electrical outlet box so that a length of standard appliance cord or cable simply cut to the exact desired length, but unprepared in any other way, could have one end inserted into the lamp's connector assembly and the other end inserted into the outlet box's connector assembly whereby power is supplied to the lamp without the use of any terminals, plugs or cable preparation. A cable could therefore be quickly and easily replaced without a screwdriver or any other implement. This connector is therefore usable at one or both ends in any application where two devices need to be connected by cable.

Therefore, and simply as another isolated example, a consumer that purchases a stereo receiver and several speakers could quickly and easily connect each speaker to the receiver with an exact length of cable which need not be prepared at either end other than by cutting it to length.

Although several specific uses for this cable connector have been recited herein, it will be understood that the device has application wherever an electrical signal or current is to be transmitted between a pair of electrical devices. Therefore, the breadth of the invention is not to be determined by the drawings selected as examples, but rather by the language of the following claims when given their broadest, reasonable interpretation.

I claim:

1. A cable connector for flat cable used to carry an electrical signal, comprising:

a main body defining a cavity therein;

rotating means including a shaft portion captivated for rotation in said cavity between a first orientation and a second orientation, said rotating means including an orifice extending axially therein into said shaft portion along the axis of rotation of said rotating means, said orifice having a cross sectional shape conforming with the cross sectional shape of said cable such that when said cable is inserted into said orifice the conductor of said cable is located at a distance from the axis of rotation of said rotating means whereby rotation of the rotating means rotates the cable about its longitudinal axis;

and terminal means fixedly attached to said main body and which includes a piercing point extending into said orifice when said rotating means is in its second orientation but not when it is in its first orientation, whereby rotation of said rotating means from its first orientation to its second orientation after said cable is emplaced therein causes said cable to be pierced by the piercing point and an electric connection to be effected and rotation of said rotating means from the second orientation to the first orientation causes said piercing point to be removed from said cable to thereby break the electrical connection.

2. The cable connector as set forth in claim 1, wherein said main body includes a plurality of cavities with a rotating means in each, first and second terminal means having piercing points isolated from one another and extending into opposite sides of each rotating means orifice only when the rotating means is in the second of its two orientations, and an electrical connection interconnecting the plurality of first terminals with the conductor of said cable as well as another electrical connection interconnecting the plurality of second terminals with another conductor of said cable.

3. A cable connector for flat cable having an electrical condcutor used to carry an electrical signal, comprising:

a main body defining a cavity therein;

rotating means including a shaft portion captivated for rotation in said cavity between a first orientation and a second orientation, said rotating means including an orifice extending axially into said shaft portion, said orifice having a cross sectional shape conforming to the cross sectional shape of said cable;

said shaft portion having a cut-out section located therein extending from the outer surface of said shaft portion to said orifice;

terminal means secured to said main body including a first portion defining a piercing point, said first portion extending into said cut-out section such that the engagement of said first portion with said cut-out section of said shaft portion retains said rotating means in said main body, said piercing point extending into said orifice when said rotating means is in its second orientation but not when it is in its first orientation, whereby rotation of said rotating means from its first orientation to its second orientation after said cable is placed therein causes said cable to be pierced by the piercing point and an electrical connection to be made between the terminal means and the electrical conductor of the cable and rotation of said rotating means from its second orientation to its first orientation causes said piercing point to be removed from said cable to thereby break the electrical connection.

4. The cable connector as set forth in claim 3, further including a panel trapped between said rotating means and said main body.

5. The cable connector as set forth in claim 3, wherein said main body includes a plurality of cavities with rotating means in each.

6. The cable connector as set forth in claim 5, wherein said terminal means includes first and second terminals each including said first portions defining said piercing points isolated from one another and extending through longitudinally spaced cut-out sections formed in diametrically opposite sides of each of said shaft portions.

* * * * *